US008176857B2

(12) United States Patent
Ochs

(10) Patent No.: US 8,176,857 B2
(45) Date of Patent: May 15, 2012

(54) VERSATILE FURNITURE UNITS SUITABLE FOR CHILDREN

(76) Inventor: Kyle A. Ochs, Indianapolis, IN (US)

( * ) Notice: Subject to any disclaimer, the term of this patent is extended or adjusted under 35 U.S.C. 154(b) by 182 days.

(21) Appl. No.: 12/661,800

(22) Filed: Mar. 24, 2010

(65) Prior Publication Data

US 2011/0232534 A1 Sep. 29, 2011

(51) Int. Cl.
*A47B 57/00* (2006.01)

(52) U.S. Cl. ..... 108/64; 108/23

(58) Field of Classification Search ..... 108/64, 108/56.1, 54.1, 50.01, 50.2, 23, 50.11; 312/111, 312/194, 196
See application file for complete search history.

(56) References Cited

U.S. PATENT DOCUMENTS

| | | | | |
|---|---|---|---|---|
| 1,051,983 | A * | 2/1913 | Brown | 108/64 |
| 2,836,475 | A * | 5/1958 | Sapp | 108/64 |
| 3,267,881 | A * | 8/1966 | Saggione | 108/64 |
| 3,742,869 | A | 7/1973 | Polsky et al. | |
| 4,163,592 | A * | 8/1979 | Nelson | 108/64 |
| 4,880,248 | A * | 11/1989 | Elmer | 108/64 |
| 5,016,405 | A * | 5/1991 | Lee | 108/64 |
| D347,527 | S | 6/1994 | Breen et al. | |
| 5,341,749 | A | 8/1994 | Noakes | |
| 5,360,264 | A | 11/1994 | Crane | |
| 5,615,619 | A | 4/1997 | King | |
| 5,809,905 | A * | 9/1998 | John et al. | 108/64 |
| 5,860,369 | A * | 1/1999 | John et al. | 108/56.1 |
| D406,757 | S | 3/1999 | Bean et al. | |
| 6,234,087 | B1 * | 5/2001 | Brown | 108/56.1 |
| 6,325,692 | B1 | 12/2001 | Webb | |
| 6,415,723 | B1 | 7/2002 | Kopish et al. | |
| 6,464,423 | B1 | 10/2002 | Klein | |
| 6,561,739 | B1 * | 5/2003 | Garala | 410/46 |
| 6,568,506 | B1 | 5/2003 | Donnalley | |
| 6,736,075 | B2 * | 5/2004 | Jackson | 108/64 |
| 7,334,529 | B1 * | 2/2008 | Liao | 108/57.26 |

OTHER PUBLICATIONS

"Step Stool by Nuby"—Product description located at http://www.pottytrainingconcepts.com/Nuby-Step-Stool.html; 2 pages; unknown date.

"Scooter Pod Rolling Step Stool"—Product description located at http://www.stepstooluniverse.com/Blue-Scooter-Pod-Rolling-Step-Stool-p/bluescooterpodr; 2 pages; unknown date.

"Deluxe Canyon Road Train and Track Table"—Product description located at http://www.ecmdstore.com/Product/ProductDetail.aspx?product=17906&es=1257140; 2 pages; unknown date.

(Continued)

*Primary Examiner* — Jose V Chen

(74) *Attorney, Agent, or Firm* — Bose McKinney & Evans LLP

(57) ABSTRACT

A furniture unit adapted for use with another unit having a similar design. The furniture unit includes a top panel, a latch member and a slot. The latch member projects outwardly from the furniture unit proximate the top panel and the slot is defined in the furniture unit proximate the top panel. The slot is adapted to securably receive the latch member whereby the two furniture units can be secured together. A plurality of legs extends away from the top panel. The legs are angled progressively outwardly as the legs extend away from the top panel whereby the furniture units can be stacked on top of one another for storage. Various accessories are disclosed which can be used with the furniture unit.

9 Claims, 5 Drawing Sheets

OTHER PUBLICATIONS

"Little Tikes—Juvenile Furniture Easy Adjust Play Table"—Product description located at http://www.toysandgamesonline.com/asp/show_detail.asp?sku=JD; 2 pages; unknown date.

Little Tikes International, Hudson, Ohio, 7106 Assembly Instructions, 1 page, Unknown date.

* cited by examiner

VERSATILE FURNITURE UNITS SUITABLE FOR CHILDREN

BACKGROUND OF THE INVENTION

1. Field of the Invention

The present invention relates to small furniture units and, more particularly, to small tables suitable for use with children.

2. Description of the Related Art

A variety of children's tables and other furniture units are known. Many of these units include small storage spaces for holding toys or other similar items when such items are not in use. While such furniture units typically serve their intended function, a small table having improved functionality would prove beneficial to many parents and other caretakers.

SUMMARY OF THE INVENTION

The present invention provides a small furniture unit that can be interlocked with other similar units to form a group when in use and stacked with other similar units for storage purposes. The furniture units include various attachment features that allow a wide variety of different accessories to be used with the furniture units.

The invention comprises, in one form thereof, a furniture unit adapted for use with a second furniture unit having a substantially identical design. The furniture unit includes a top panel, at least one latch member and at least one slot. The top panel defines a generally planar upward facing activity surface and a perimetrical edge surface. The at least one latch member is disposed on the furniture unit proximate the top panel and projects laterally outwardly of the perimetrical edge surface. The at least one slot is defined in the furniture unit proximate the top panel and is adapted to securably receive the latch member whereby the furniture unit can be secured together with the second furniture unit. A plurality of legs extends away from the top panel. The legs are angled progressively outwardly as the legs extend away from the top panel whereby the furniture unit is stackable on the second furniture unit.

The invention comprises, in another form thereof, a furniture system including a first furniture unit and a second furniture unit. The first furniture unit includes a top panel, at least one latch member, at least one slot and a plurality of legs. The top panel defines a generally planar upward facing activity surface and a perimetrical edge surface. The at least one latch member is disposed on the furniture unit proximate the top panel and projects laterally outwardly of the perimetrical edge surface. The at least one slot is defined in the first furniture unit proximate the top panel. The plurality of legs extend away from the top panel with the legs being angled progressively outwardly as the legs extend away from the top panel. The second furniture unit includes one of a cooperating latch member and a cooperating slot wherein the cooperating latch is engageable with the at least one slot disposed on the first furniture unit and the cooperating slot is engageable with the at least one latch member disposed on the first furniture unit whereby the first and second furniture units are detachably securable.

The furniture units described herein provide a versatile system which allows the tables to be secured together in larger groups and also allows a wide variety of accessories to be used with one or more of the tables. The tables and many of the accessories can be cost efficiently manufactured using injected molded plastic materials.

BRIEF DESCRIPTION OF THE DRAWINGS

The above mentioned and other features of this invention, and the manner of attaining them, will become more apparent and the invention itself will be better understood by reference to the following description of an embodiment of the invention taken in conjunction with the accompanying drawings, wherein.

Figure 1:
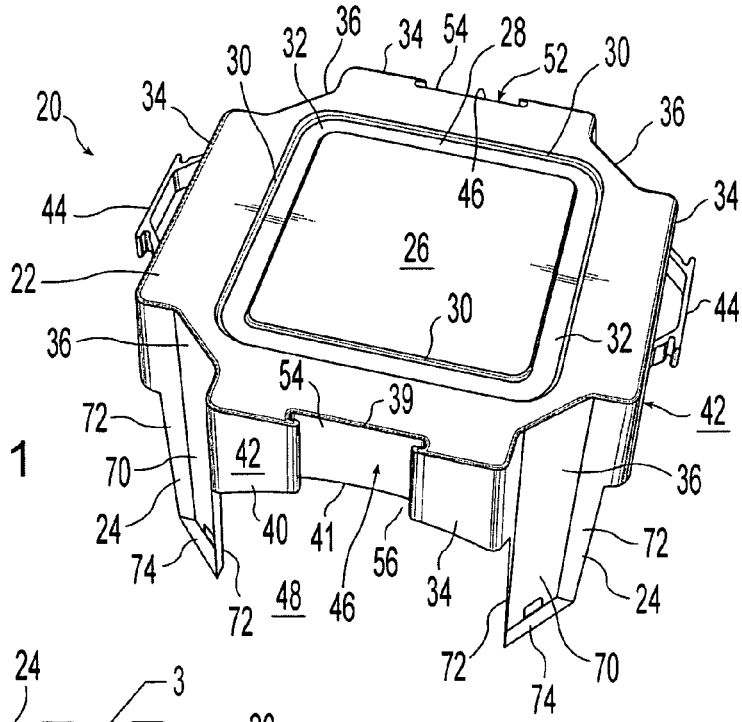
FIG. 1 is a perspective view of a table in accordance with the present invention.

Corresponding reference characters indicate corresponding parts throughout the several views. Although the exemplification set out herein illustrates an embodiment of the invention, in one form, the embodiment disclosed below is not intended to be exhaustive or to be construed as limiting the scope of the invention to the precise form disclosed.

DETAILED DESCRIPTION OF THE INVENTION

A table 20 in accordance with the present invention is shown in FIG. 1. Table 20 includes a top panel 22 and a plurality of legs 24. Top panel 22 has a generally planar upward facing activity surface 26. A recess 28 is formed on the activity surface 26. When viewed from above, recess 28 forms a closed loop and has a generally orthogonal shape with rounded corners. Recess 28 has sidewalls 30 that taper slightly whereby recess 28 becomes progressively narrower nearer its bottom surface 32.

In the illustrated embodiment, top panel 22 has four side edges 34 and four corners 36. Side edges 34 and truncated corners 36 define the outer perimeter 38 of top panel 22 which, as can be seen in the figures, is substantially orthogonal. If side edges 34 were extended until each of the edges 34 intersected, the outer perimeter 38 would define a 24 inch by 24 inch square. Although the symmetry of the generally square shape of top panel 22 provides flexibility in the positioning and interlocking of tables 20, top panels having alternative shapes can also be employed with the present invention.

A skirt 40 extends downwardly from activity surface 26 and forms an edge surface 42 along the outer perimeter 38 of top panel 22. In the illustrated embodiment, skirt 40 extends around the entire outer perimeter 38 and forms the uppermost portion of the four legs 24 which are located at corners 36. Latch members 44 and slots 46 are located on the perimetrical edge surface 42. By inserting a latch member 44 of a first table 20 into the cooperating slot 46 of a second table 20, the tables can be detachably secured together.

Figure 2:
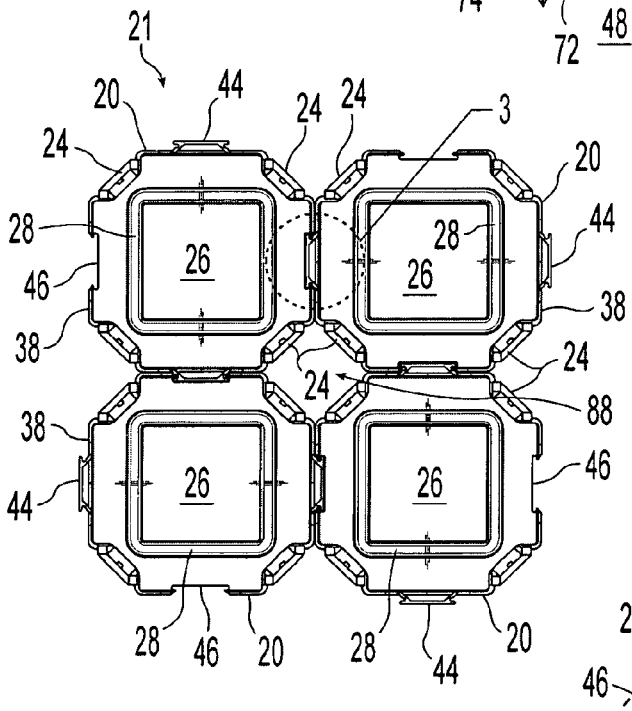
FIG. 2 is a plan view of four tables linked together.
Figure 3:
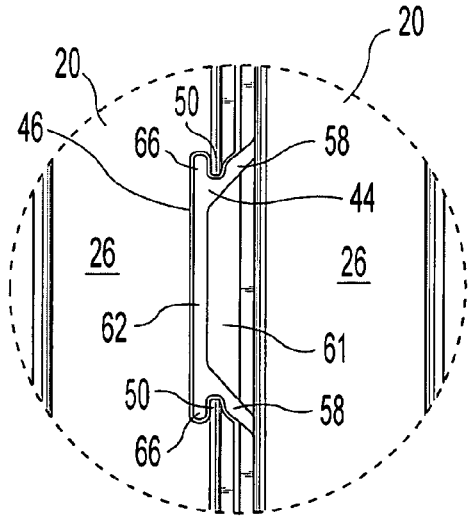
FIG. 3 is a detail view of a portion of FIG. 2 showing the interconnection between two tables.
Figure 8:
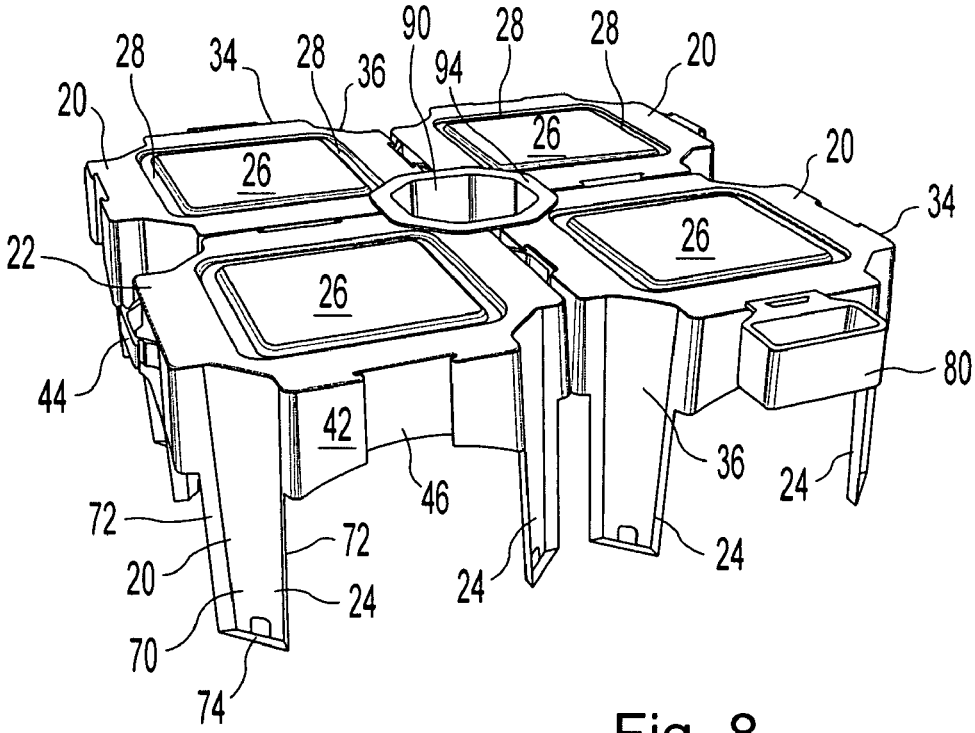
FIG. 8 is a perspective view of four linked tables having accessory units mounted thereon.

Each of the illustrated tables 20 includes a pair of latches 44 disposed opposite one another and a pair of slots 46 that are also disposed opposite one another. By positioning the pair of latches 44 at the midpoint of oppositely disposed lateral sides 34 and similarly positioning the pair of slots 46 at the midpoint of the other set of oppositely disposed lateral sides 34, the tables 20 can be ganged together in large groups. FIGS. 2 and 8 depict a group of four tables 20 ganged together. Even larger groupings of tables 20, however, can also be formed. As best understood with reference to FIGS. 2 and 8, the positioning of latches 44 and slots 46 at the midpoint of oppositely disposed lateral sides 34 allows the tables 20 to be ganged together in an expanding grid pattern and does not limit the attachment of tables 20 to a linear formation.

Figure 4:
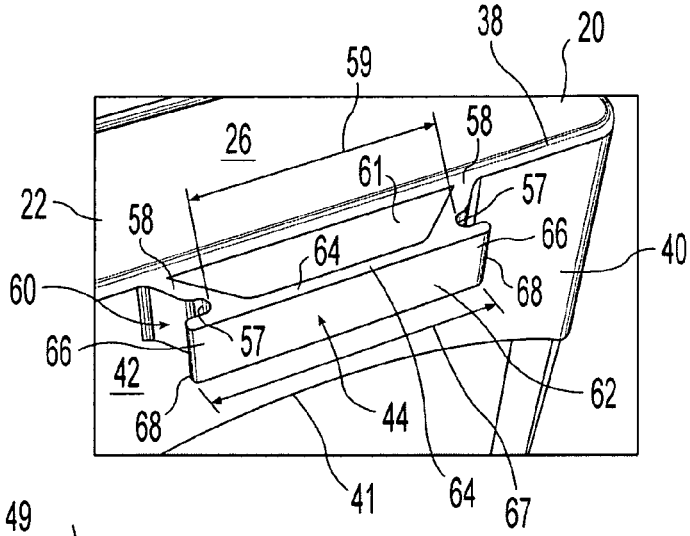
FIG. 4 is a perspective view of a latch member.
Figure 5:
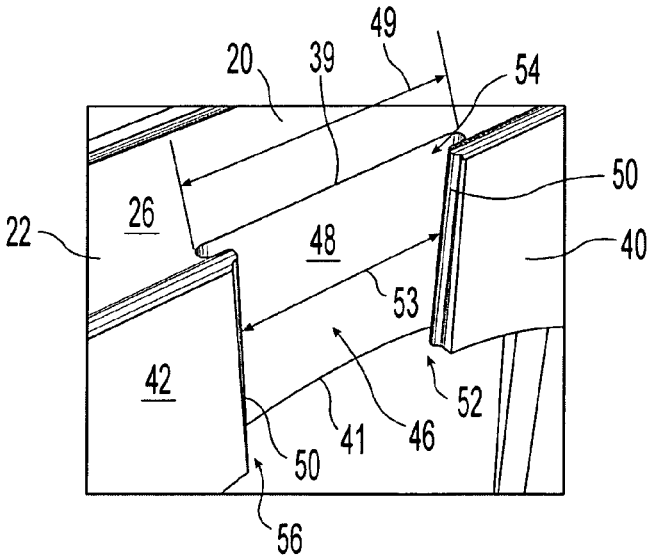
FIG. 5 is a perspective view of a slot for receiving a latch member.

As seen in FIG. 5, skirt 40 defines the slots 46 in the illustrated embodiment. Similarly, as seen in FIG. 4, latches 44 extend outwardly from skirt 40. Although the illustrated latches 44 and slots 46 are located on skirt 40, alternative embodiments of the tables 20 could have latches 44 and slots 46 positioned proximate the top panel 22. The latches and slots of such alternative embodiments could be used in a manner similar to the latches 44 and slots 46 described herein.

Slots 46 are best seen in FIGS. 1 and 5 and include a rear slot surface 48 and a pair of inwardly projecting lips 50. The lips 50 are located laterally outwardly of rear slot surface 48 to thereby define a space between rear surface 48 and lips 50 for receiving a latch member 44. The lips 50 also define a gap 52 between the opposed lips 50. To secure latch 44 within slot 46, the width 53 of the gap 52 is smaller than the width 49 of rear surface 48. Rear slot surface 48, lips 50 and gap 52 all extend vertically and intersect activity surface 26 to thereby define an upper opening 54 in activity surface 26. In the illustrated embodiment, slot 46 extends the full height of skirt 40, i.e., from the upper edge 39 of skirt 40 defined by activity surface 26 to the lower edge 41 of skirt 40, and thereby defines not only an upper slot opening 54 but also a lower slot opening 56.

When attaching tables 20 together, a latch 44 can be inserted through either the upper (54) or lower (56) opening into a slot 46 of another table to thereby secure the tables 20 together. Similarly, latch 44 can be removed from slot 46 through either upper (54) or lower (56) opening when detaching the tables 20.

Latch member 44 projects laterally from skirt 40 and outward beyond the perimetrical edge 38 of activity surface 26. The combination of an outwardly projecting latch 44 and a slot 46 recessed such that it defines an upper opening 54 in activity surface 26, allows two tables 20 to be secured together with their adjacent side edges 34 being positioned adjacent one another with only a minimal or no gap between the adjacent side edges 34. Latches 44 include two support arms 58 forming a laterally outwardly projecting support section 60 and an outer beam 62 that has a central section 64 and two arms 66 disposed on opposite ends of support section 60 and extending generally transverse to the laterally projecting support arms 58. In the illustrated embodiment, support section 60 has an opening 61 formed between support arms 58 and support arms 58 define recesses 57 on their outward facing surfaces.

To securely interfit latch 44 with a cooperating slot 46 the dimensions of latches 44 and slots 46 are interrelated with recesses 57 being sized to closely receive lips 50. More specifically, at recesses 57, the support section 60 defines a width 59 no greater than the width 53 of gap 52 while the distal ends 68 of arms 66 define a width 67 that is greater than the width 53 of gap 52 and no greater than the width 49 of rear slot surface 48. As will be readily understood by a person having ordinary skill in the art, the lateral dimensions of latch 44 are sized to permit the insertion of latch 44 into slot 46. The use of latches 44 and slots 46 enables tables 20 to be secured together without the use of moveable latch members thereby enhancing the durability and cost efficient manufacture of tables 20.

Figure 6:
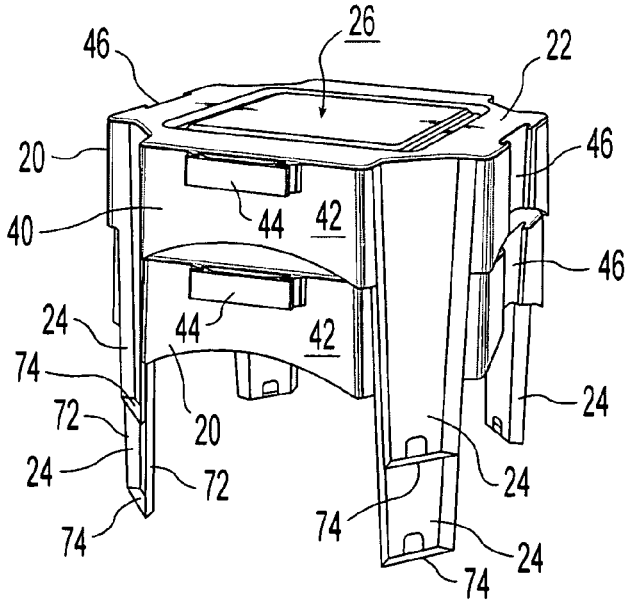
FIG. 6 is a view of two tables stacked together.
Figure 7:
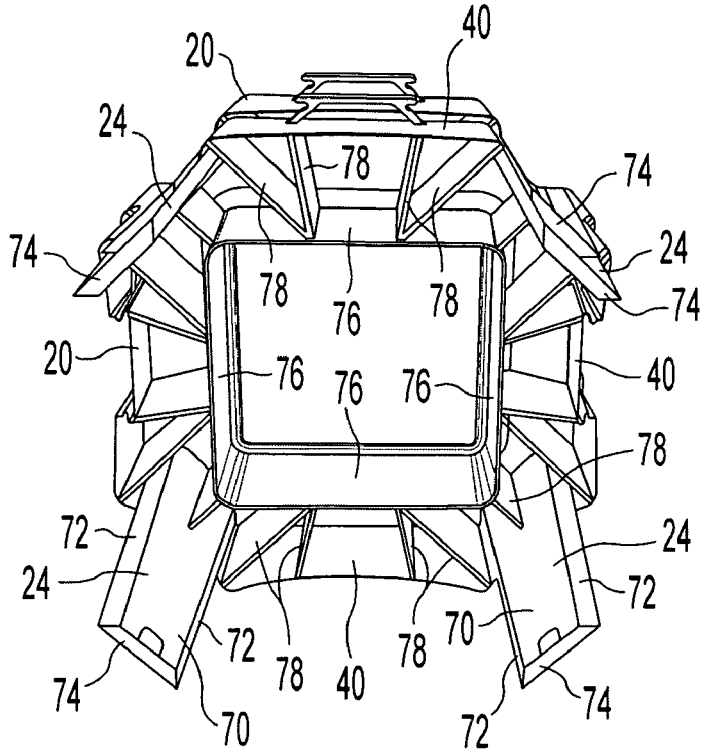
FIG. 7 is a bottom perspective view of two stacked tables.

To facilitate the stacking of tables 20, legs 24 are angled progressively outwardly as legs extend away from top panel. This allows the legs 24 of one table 20 to be slid down and laterally outwardly of the legs 24 of a second table 20 as depicted in FIGS. 6 and 7. Legs 24 include a central panel 70, side flanges 72 and a bottom flange 74. The side and bottom flanges 72, 74 enhance the rigidity of legs 24. The bottom flange 74 also provides an increased surface area for engagement with the floor surface.

The illustrated table 20 is advantageously formed out of an injected molded resinous material although a wide variety of other materials can also be used to form a table 20. An inner skirt 76 and reinforcing ribs 78 are formed on the bottom side of activity surface 26 to enhance the strength and rigidity of top panel 22. The inner skirt 76 projects downwardly from the activity surface 26 and forms a closed loop that is positioned inwardly of outer skirt 40. In the illustrated embodiment, inner skirt 76 is positioned directly beneath and follows the course of recess 28. Reinforcing ribs 78 also project downwardly from activity surface 26 and are disposed between and interconnect outer skirt 40 and inner skirt 76. Reinforcing ribs 78 also extend between and interconnect inner skirt 76 with the uppermost portion of legs 24. The reinforcement structure provided by inner skirt 76 and ribs 78 are best seen in FIG. 7. By providing reinforcement members 76, 78 on the underside of activity surface 26 and flanges 72, 74 on legs 24, the thickness of the injected resin material forming the structure of table 20 can be approximately 0.25 inches throughout the table. In other words, activity surface 26, inner and outer skirts 76, 40 and ribs 78 and legs 24 are each approximately 0.25 inches thick.

In addition to securing multiple tables 20 together to form a group of tables, various accessories can also be employed with tables 20. Recess 28, latches 44 and slots 46 can all be used to facilitate the use of such accessories with tables 20 by inhibiting relative movement between the accessory and table 20. By providing tables 20 with various means of attachment to other furniture items, e.g., either other tables 20 or accessories, tables 20 provide a furniture system with great flexibility that can be combined together in wide variety of different configurations for a variety of different uses. The accessories that can be used with tables 20 may take many forms and be mounted in various manners. The illustrated accessories are exemplary of the types of accessories that may be used with tables 20 and are not intended to provide an exhaustive catalog of the many potential accessories that could be employed with tables 20.

Figure 9:
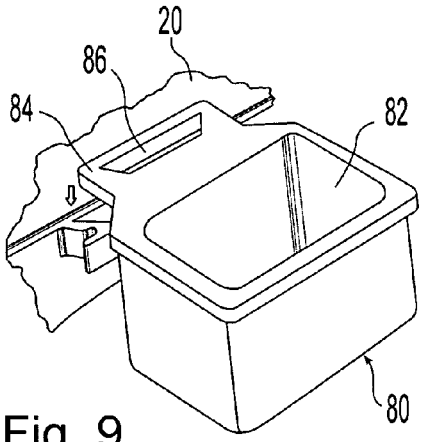
FIG. 9 is an exploded perspective view of a side storage unit and table edge.
Figure 10:
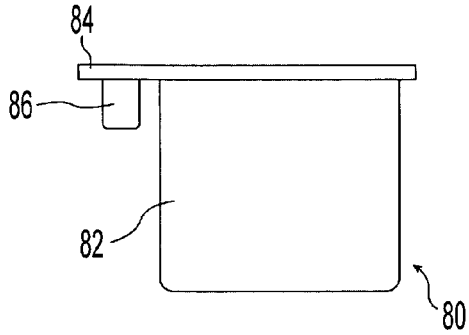
FIG. 10 is a side view of the storage unit of FIG. 9.

The first example of such an accessory can be seen in FIGS. 8, 9 and 10 which illustrate a side-mounted storage bin 80. Bin 80 can be attached to the latch 44 of a table 20 and used for holding drawing instruments or other small items. Bin 80 includes a storage compartment 82 and an outwardly projecting flange 84. Flange 84 rests on top of latch 44 and includes a projection 86 that extends downwardly. Projection 86 is sized to fit snugly within opening 61 in the support section 60 of latch 44. The engagement flange 84 with latch 44 and the insertion of projection 86 within opening 61 supports bin 80 on the side of a table 20. While bin 80 can be manufactured using a variety of different materials and methods, bin 80 can be readily manufactured in a cost effective manner by an injection molding process using a resinous material.

Figure 11:
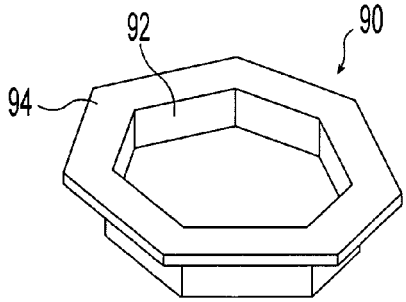
FIG. 11 is a perspective view of a center storage unit.

As seen in FIG. 2, four tables 20 can be secured together in a generally square shaped group 21 to form a central opening 88 between tables 20 at the center of group 21. Various accessories can be positioned in the central opening 88. One such accessory is the center storage bin 90 which can be seen in FIGS. 8 and 11. Bin 90 includes a storage compartment 92 that can be inserted into central opening 88 and a flange 94 that extends outwardly from the upper edge of compartment 92. Outwardly extending flange 94 engages each of the four tables 20 to thereby support bin 90 on the tables 20. Bin 90 provides storage space for small items and also prevents objects located on activity surfaces 26 from accidentally falling through opening 88.

Figure 16:
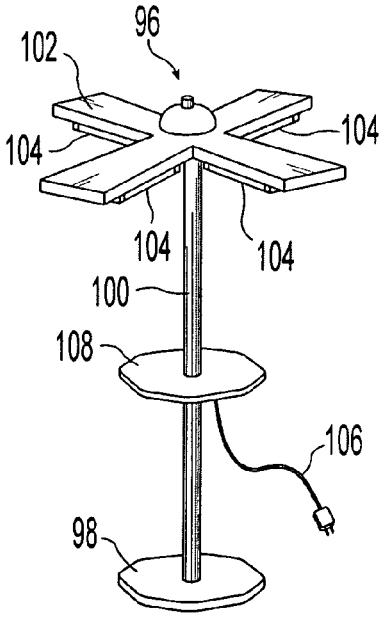
FIG. 16 is perspective view of a center lamp accessory unit.
Figure 17:
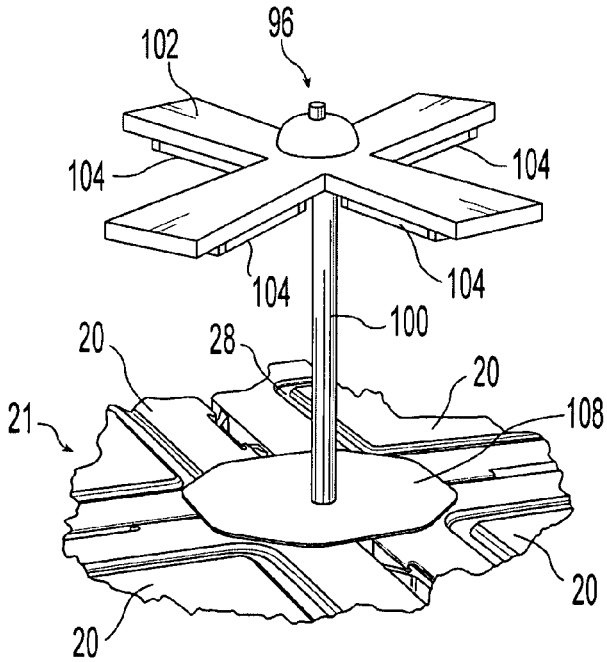
FIG. 17 is perspective view of the center lamp positioned within a group of tables.

Another example of an accessory that can be positioned in central opening 88 is free standing light fixture 96 schematically represented in FIGS. 16 and 17. Light fixture 96 includes a floor plate 98 and a central post 100 which extends upwardly therefrom. A support structure 102 is located on the upper end of post 100 and supports a plurality of fluorescent light fixtures and bulbs 104. An electrical power cord 106 is routed through center post 100 and can be inserted into a conventional electrical outlet to power light fixture 96. A shelf 108 is mounted on post 100 and is positioned at a height that positions shelf 108 proximate and just above activity surfaces 26 when light fixture 96 is positioned in central opening 88. Shelf 108 has a shape that is configured to fully cover opening 88 and thereby inhibit small items located on activity surfaces 26 from falling to the floor through opening 88. In the illustrated embodiment, shelf 108 has a shape that closely mimics the shape of opening 88. In alternative embodiments, however, shelf 108 could be circular and thereby allow light fixture 96 to be located within opening 88 at any rotational position relative to tables 20 and still have shelf 108 cover opening 88.

Figure 12:
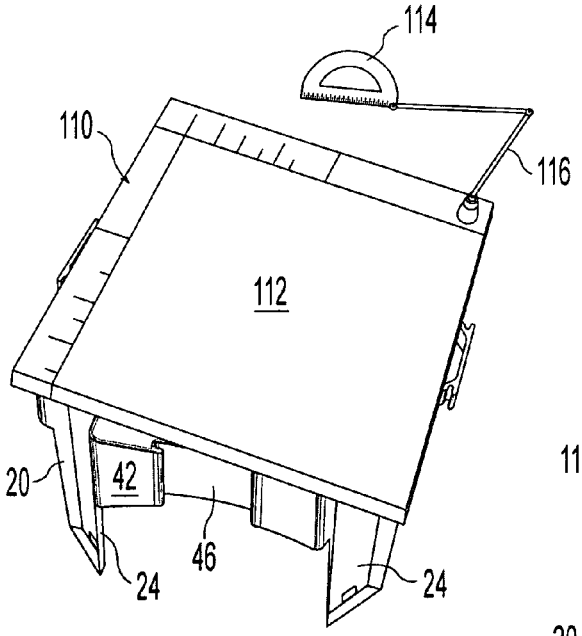
FIG. 12 is a perspective view of a drafting table accessory unit.
Figure 13:
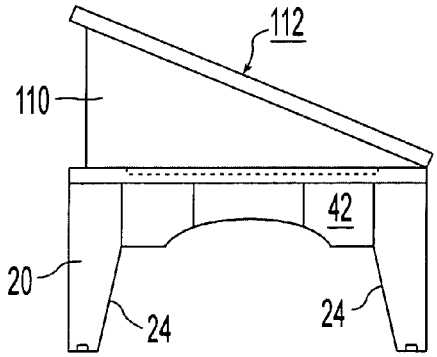
FIG. 13 is a schematic side view of the drafting table accessory unit.

Still other accessories may be placed on the top of activity surfaces 26 of tables 20. A drafting table unit 110 is illustrated in FIGS. 12 and 13. Drafting table unit 110 sits on top of the activity surface 26 of a table 20. As best understood with reference to FIG. 13, drafting table unit 110 has a wedge shaped profile whereby the work surface 112 of accessory 110 will be disposed at an angle relative to the activity surface 26 when accessory 110 is positioned on surface 26. Accessory 110 may optionally include a protractor or stencil 114 on an articulating arm 116.

Figure 14:
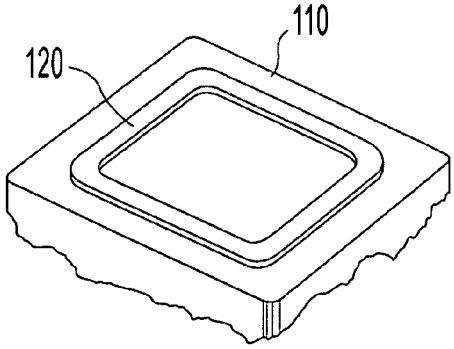
FIG. 14 is a bottom perspective view of a table top accessory unit.

The underside 118 of accessory 110 is schematically depicted in FIG. 14 and includes a projecting rib 120. Rib 120 is engageably disposable in recess 28 to thereby inhibit relative movement between accessory 110 and the table 20 on which it is positioned.

Figure 15:
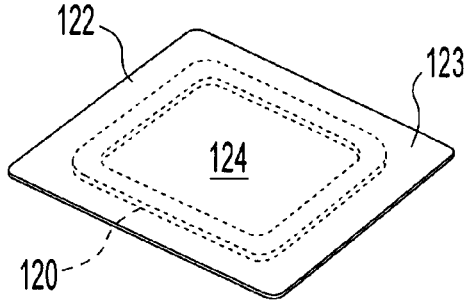
FIG. 15 is a perspective view of another table-top accessory.

Another table-top accessory 122 is depicted in FIG. 15. Accessory 122 provides a means for altering the appearance of activity surface 26. Accessory 122 includes a thin planar panel 123 with an upper surface 124 that is positioned substantially parallel and proximate the activity surface 26 when panel 123 is positioned on surface 26. A downwardly projecting rib 120 engages recess 28 to inhibit movement of panel 123. The upper surface 124 provides an activity surface similar to surface 26 on which the user of table 20 can undertake various activities such as drawing or playing with small toys. The upper surface 124 can also have a functional purpose. For example, surface 124 could be printed with the layout of a checkerboard, backgammon board or other board game. A user could thereby have multiple panels 123 and select a particular panel 123 for placement on table 20 depending upon which board game the user desired to play.

Upper surface 124 can also be provided with graphical images to change the look of table 20 for aesthetic purposes. For example, surface 124 can have an image of a famous cartoon character printed thereon or some other image appealing to the users of table 20. The user of a table 20 could have several different panels 123 and thereby have the ability to easily change the visual image of table 20. It would also be possible for users to customize the appearance of either activity surface 26 or upper surface 124 of a panel 123 by placing one or more stickers on the surface 124 of panel 123 or directly on the activity surface 26. It would generally be advantageous to limit any such stickers to the area of activity surface 26 located within the confines of recess 28.

While this invention has been described as having an exemplary design, the present invention may be further modified within the spirit and scope of this disclosure. This application is therefore intended to cover any variations, uses, or adaptations of the invention using its general principles.

What is claimed is:

1. A furniture system, said system comprising:

(a) a first furniture unit, said first furniture unit comprising:

a top panel defining a generally planar upward facing activity surface and a perimetrical edge surface;

at least one latch member projecting disposed on said furniture unit proximate said top panel and projecting laterally outwardly of said perimetrical edge surface;

at least one slot defined in said furniture unit proximate said top panel;

a plurality of legs extending away from said top panel, said legs being angled progressively outwardly as said legs extend away from said top panel; and (b) a second furniture unit, said second furniture unit including one of a cooperating latch member and a cooperating slot wherein said cooperating latch is engaged with said at least one slot disposed on said first furniture unit and said cooperating slot is engaged with said at least one latch member disposed on said first furniture unit whereby said first and second furniture units are detachably secured;

third and fourth furniture units wherein said first, second, third and fourth furniture units all have substantially identical designs, said first, second, third and fourth furniture units being detachably secured together in a group defining a central opening; and an accessory unit disposable within said central opening wherein said accessory unit is a storage bin positioned in said central opening and having an outwardly extending flange engaged with said first, second, third and fourth furniture units whereby said storage bin is removeably supported on said first, second, third and fourth furniture units.

2. The furniture system of claim 1 wherein said first, second, third and fourth units are stackable when detached.

3. A furniture system, said system comprising:

(a) a first furniture unit, said first furniture unit comprising:

a top panel defining a generally planar upward facing activity surface and a perimetrical edge surface;

at least one latch member projecting disposed on said furniture unit proximate said top panel and projecting laterally outwardly of said perimetrical edge surface;

at least one slot defined in said furniture unit proximate said top panel;

a plurality of legs extending away from said top panel, said legs being angled progressively outwardly as said legs extend away from said top panel; and (b) a second furniture unit, said second furniture unit including one of a cooperating latch member and a cooperating slot wherein said cooperating latch is engaged with said at least one slot disposed on said first furniture unit and said cooperating slot is engaged with said at least one latch member disposed on said first furniture unit whereby said first and second furniture units are detachably secured;

third and fourth furniture units wherein said first, second, third and fourth furniture units all have substantially identical designs, said first, second, third and fourth furniture units being detachably secured together in a group defining a central opening; and an accessory unit disposable within said central opening wherein said accessory unit is a free standing light fixture extends through said central opening and having a shelf positioned on said light fixture whereby, when said accessory unit extends through said central opening, said shelf is positioned proximate said top panels of said first, second, third and fourth furniture units and wherein said shelf has a shape that substantially covers said central opening.

4. A furniture system, said system comprising:

(a) a first furniture unit, said first furniture unit comprising:

a top panel defining a generally planar upward facing activity surface and a perimetrical edge surface;

at least one latch member projecting disposed on said furniture unit proximate said top panel and projecting laterally outwardly of said perimetrical edge surface;

at least one slot defined in said furniture unit proximate said top panel;

a plurality of legs extending away from said top panel, said legs being angled progressively outwardly as said legs extend away from said top panel; and (b) a second furniture unit, said second furniture unit including one of a cooperating latch member and a cooperating slot wherein said cooperating latch is engaged with said at least one slot disposed on said first furniture unit and said cooperating slot is engaged with said at least one latch member disposed on said first furniture unit whereby said first and second furniture units are detachably secured; and wherein said top panel of said first furniture unit defines a recess forming a closed loop on said upward facing activity surface and wherein said system further comprises an accessory unit removeably disposed on said top panel, said accessory unit including a projecting rib engageably disposed within said recess to thereby inhibit relative movement between said top panel and said accessory unit when said accessory unit is disposed on said top panel.

5. The furniture system of claim 4 wherein said accessory unit defines a work surface, said work surface being disposed at an angle relative to said activity surface when said rib is disposed within said recess.

6. The furniture system of claim 4 wherein said accessory unit defines an upper surface, said upper surface being disposed substantially parallel and proximate said activity surface when said rib is disposed within said recess.

7. A furniture system, said system comprising:

(a) a first furniture unit, said first furniture unit comprising:

a top panel defining a generally planar upward facing activity surface and a perimetrical edge surface;

at least one latch member projecting disposed on said furniture unit proximate said top panel and projecting laterally outwardly of said perimetrical edge surface;

at least one slot defined in said furniture unit proximate said top panel;

a plurality of legs extending away from said top panel, said legs being angled progressively outwardly as said legs extend away from said top panel; and (b) a second furniture unit, said second furniture unit including one of a cooperating latch member and a cooperating slot wherein said cooperating latch is engaged with said at least one slot disposed on said first furniture unit and said cooperating slot is engaged with said at least one latch member disposed on said first furniture unit whereby said first and second furniture units are detachably secured; and wherein said first and second furniture units have substantially identical designs and further comprising a storage bin removeably supported on a selected one of said latch members.

8. The furniture system of claim 7 wherein said latch members each define a latch opening and said storage bin includes an outwardly extending flange and a projection extending from said flange wherein said flange is supported on a selected on of said latch members when said projection is inserted through said latch opening of said selected latch member.

9. The furniture system of claim 8 wherein said top panels of each of said first and second furniture units defines a recess forming a closed loop on said upward facing activity surface and wherein said system further comprises an accessory unit removeably disposed on a respective one of said top panels, said accessory unit including a projecting rib engageably disposed within said respective recess to thereby inhibit relative movement between said respective top panel and said accessory unit when said accessory unit is disposed on said respective top panel.

* * * * *